US007111748B2

(12) United States Patent
Cha

(10) Patent No.: US 7,111,748 B2
(45) Date of Patent: Sep. 26, 2006

(54) STABLE THERMOS MULTI-CUP

(76) Inventor: Won Il Cha, 319 W. Lambert Rd. #56, Brea, CA (US) 92821

( * ) Notice: Subject to any disclaimer, the term of this patent is extended or adjusted under 35 U.S.C. 154(b) by 334 days.

(21) Appl. No.: 10/608,957

(22) Filed: Jun. 30, 2003

(65) Prior Publication Data

US 2004/0262323 A1 Dec. 30, 2004

(51) Int. Cl.
*B65D 21/032* (2006.01)

(52) U.S. Cl. ..... 220/4.27; 220/709

(58) Field of Classification Search ..... None
See application file for complete search history.

(56) References Cited

U.S. PATENT DOCUMENTS 5,180,079 A * 1/1993 Jeng ..... 220/705
5,402,907 A * 4/1995 Liu ..... 220/502
2003/0150857 A1* 8/2003 Tsai ..... 220/4.27

* cited by examiner

*Primary Examiner*—Stephen Castellano

(57) ABSTRACT

A novel combination cup for carrying soft drinks and snacks within one cup structure is comprised of: 1) an upper cup body, 2) a lid cover for the upper cup body, 3) an insulating plate 4) a ring, and, 5) a lower cup body jointed together. The upper cup body lid cover may be used as cup holder to prevent the cup from falling over and spilling its contents. The lower cup body may be used to contain liquid drinks while the upper cup body may be used to contain solid snacks. The convenient combination of this invention enables a user to eat and drink using only one hand, and also to enjoy the cool or hot temperature of the drinks longer and safer.

1 Claim, 5 Drawing Sheets

STABLE THERMOS MULTI-CUP

This invention relates to a cup on/in a cup for carrying drinks and snacks with one hand safely while retaining the temperature of the drinks for a longer period of time.

BACKGROUND OF THE INVENTION

Most combination cups used for carrying drinks and snacks with one hand have a bulky upper cup for snacks and a long, narrow lower cusp for drinks. The overall structure of this combination cup is extremely unstable. It falls over easily even when it is set on an even, flat surface. A further drawback of the combination cup is that the upper cup body is too easily separated from the lower cup body. Yet another shortcoming of the traditional combination cup is that the temperature of the drinks in the lower cup is often quite different from that of the snack in upper cup. However, most of the previous combination cups do not have a means for insulating both of these different temperatures. Therefore, the drink and snack will both reach an undesired room-temperature level.

1. FIELD OF THE INVENTION

The present invention relates to a combination cup for soft drinks and snacks, which has an insulating means in the upper cup body and a lid cover. The lid cover may be used as a cup holder, preventing the combination cup from falling over and spilling its contents. The upper and lower cup body maybe sturdily connected with "O" ring.

2. DESCRIPTION OF PRIOR ART

U.S. patent application Ser. No. 2001/0032791 to Hudson, U.S. Pat. No. 6,425,480 to Krueger et al., U.S. Pat. No. 6,338,417 to Ferraro, U.S. Pat. No. 5,984,131 to Krueger et al., U.S. Design Patent Des. 397,911 to Waldmann, U.S. Pat. No. 5,573,131 to Berjis, U.S. Pat. No. 5,249,700 to Dumke, U.S. Pat. No. 5,180,079 to Jeng, U.S. Pat. No. 5,176,283 to Patterson et al., U.S. Pat. No. 4,938,373 to McKee, and U.S. Pat. No. 3,288,344 to Woollen et al., U.S. Pat. No. 2,740,575 to Fontaine, U.S. Pat. No. 2,503,045 to Hamilton, U.S. Pat. No. 2,287,610 to Guidry, U.S. Pat. No. 2,275,293 to Foley, U.S. Pat. No. 1,665,289 to Weaver and U.S. Pat. No. 1,213,961 to Shepard illustrate various cup on/in cup combinations.

Before the U.S. Pat. No. 3,288,344 of 1965, most combination cups were the cup-in-cup type. These were not very popular because the volume of lower cup is decreased when the upper cup is inserted into the lower cup. Most customers want the ability to put a greater volume of liquid into one cup.

From U.S. Pat. No. 5,176,283 to recent application 2001/0032791, all the related works have a cup-on-cup structure. All the upper cups of the prior arts have a larger diameter than the lower cup. Nearly all of the following have a much larger diameter: U.S. Pat. Nos. 4,938,373, 5,249,700, 5,573,131, D 397,911, 5,984,131, 6,338,417, 6,425,480, and 2001/0032791. Such a structure is highly unstable.

The other drawback of the prior arts is that none of them is equipped with a thermal insulation layer, separating the hot and cold items thermally from each other as shown in this invention.

SUMMARY OF THE INVENTION

The object of the present invention is to design a cup for storing drinks and snacks that are served at different temperatures in one, structurally stable, combined cup. The combination cup is comprised of five parts: An upper cup body, a lid cover for the upper cup body, an insulating member, an "O" ring, and a lower cup body. The insulating member is installed at the bottom of the upper cup body. The lid cover for upper cup body may be used as a bottom cup holder to put the cup on a flat surface. The lower portion of the upper cup body inserted in the lower cup body and may be fastened with an "O" ring. This invention maintains the temperatures in each cup longer and holds the contents more safely.

DETAILED DESCRIPTION OF THE PREFERRED EMBODIMENT

Figure 1:
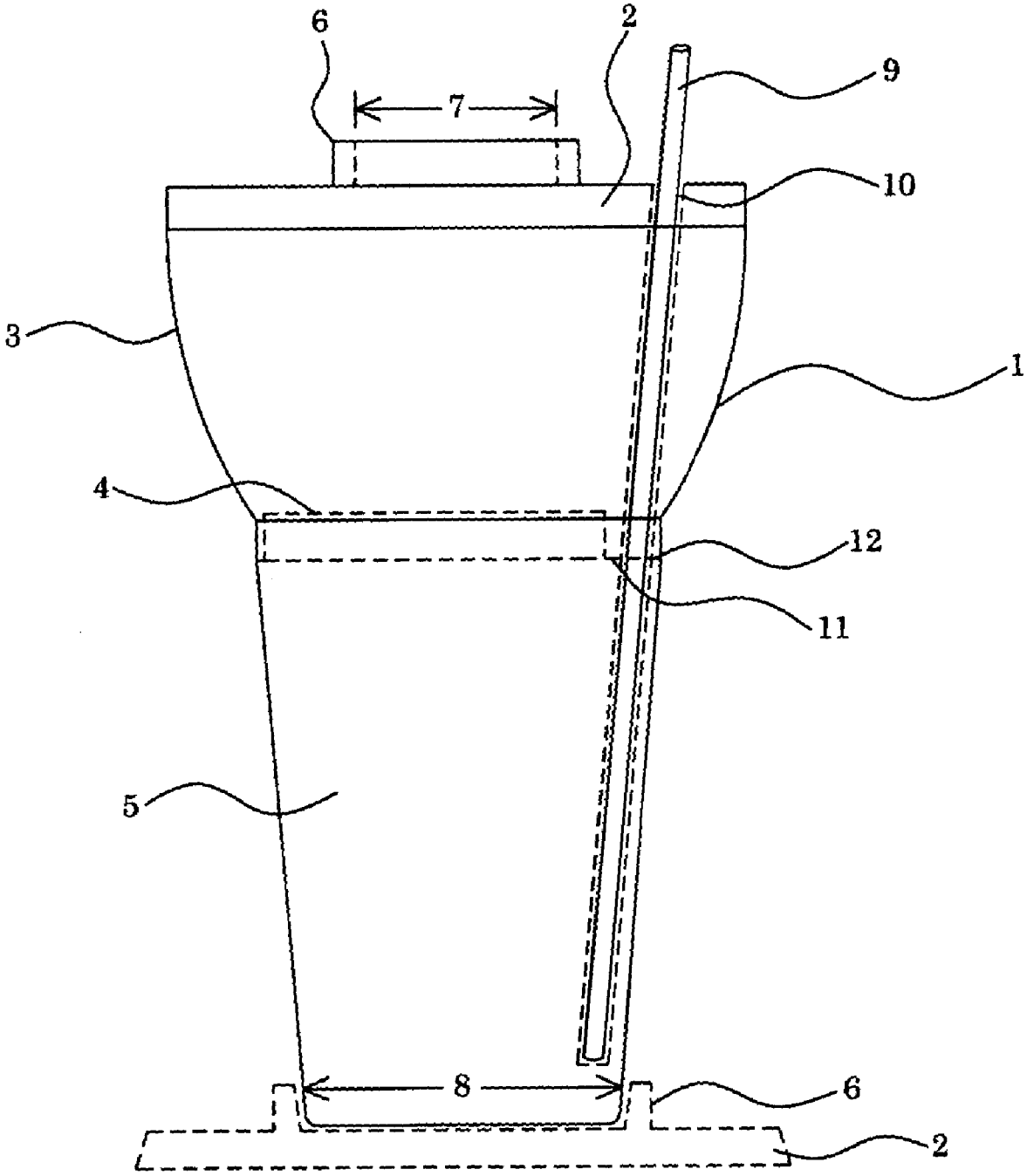
FIG. 1 is a side view of the combination cup of this invention.
Figure 2:
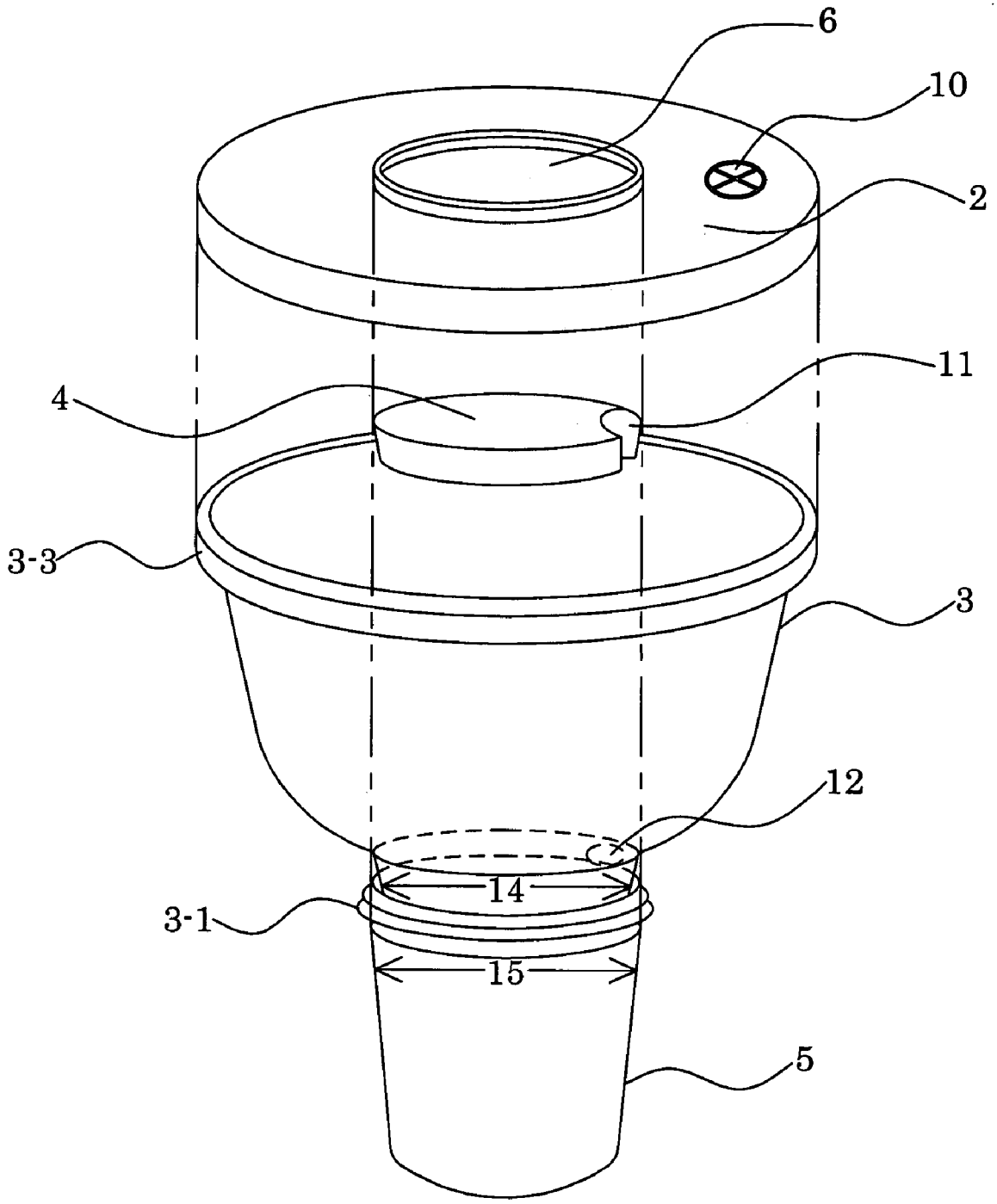
FIG. 2 is an exploded view of the combination cup of this invention.

FIG. 1 is a side view of the combination cup (1) of this invention. FIG. 2 is an exploded view of the combination cup (1). The combined cup (1) is comprised of a lid cover (2) for the upper cup body (3), an upper cup body (3), an "O" ring (3-1), a thermal insulating member (4), and a lower cup body (5). The lid cover (2) has a circular projection (6) at the center of the upper surface.

Figure 3:
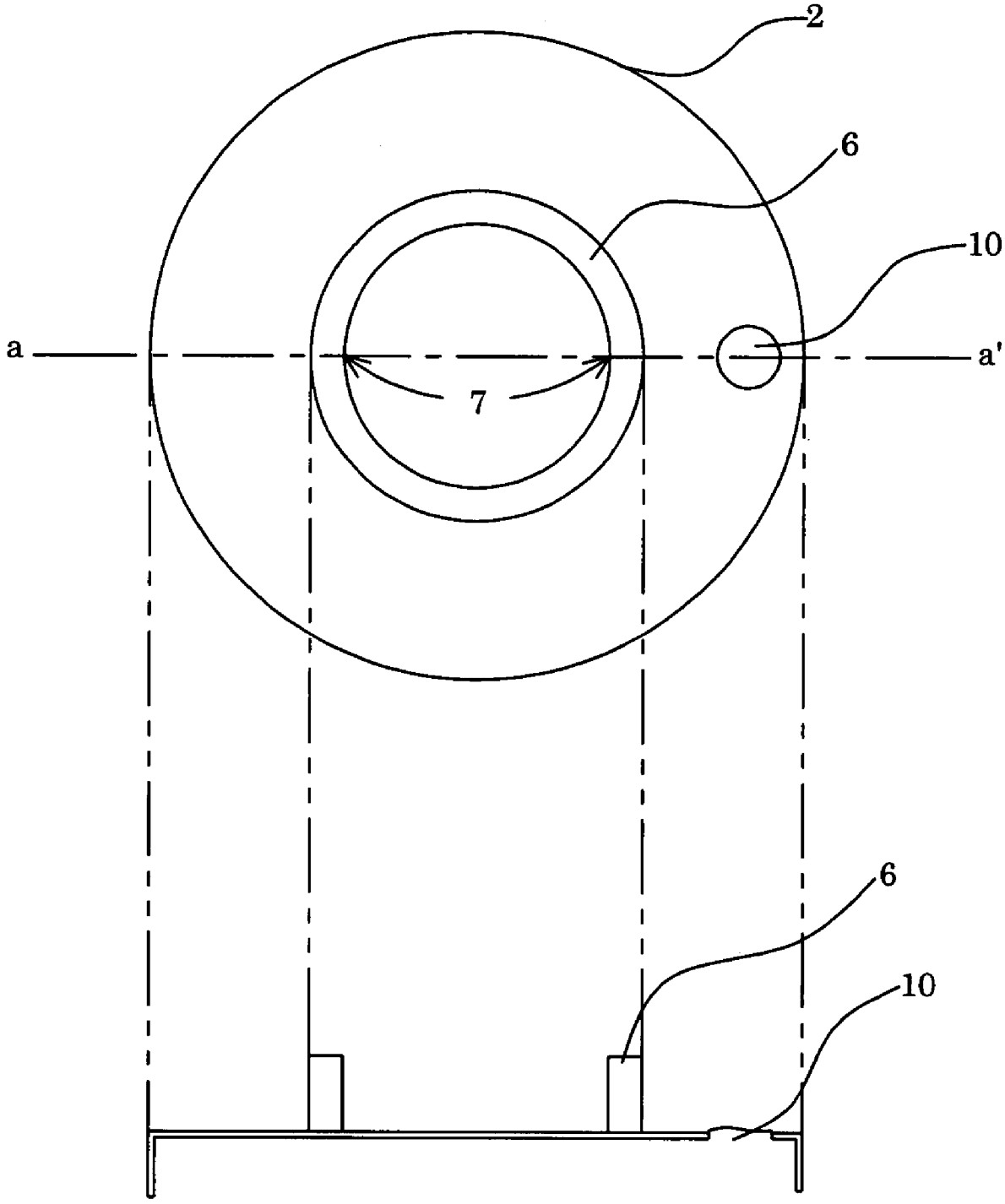
FIG. 3 is an aerial view of the lid cover and the cross-sectional view of the lid along the line a–a'.

FIG. 3 is an aerial view of the lid cover and the cross-sectional view of the lid along the line a–a'. The inner diameter (7) of the circular projection (6) is the same as the outer diameter (8) of the bottom of lower cup body (5). The lid cover (2) works as cover while a user holds the combination cup (1) in one hand and moves. If the user wants to eat the snacks and drinks, they simply take off the cover (4) and let it hang on the straw (9) inserted through holes (10), (11), and (12) for drinking. When a user stops and puts the combination cup (1) on a flat surface such as park bench, the lid cover (2) works as a cup-supporting holder. Take off the lid cover (2) from the upper cup body (3), put the lid cover (2) on a flat surface and insert the bottom of the lower cup body (5) into the circular projection (6) on the lid cover (2). The wide lid cover (2) supports the bottom of the combination cup (1) to stabilize the structure and to minimize the chance of spilling the contents in the combination cup (1).

Figure 4:
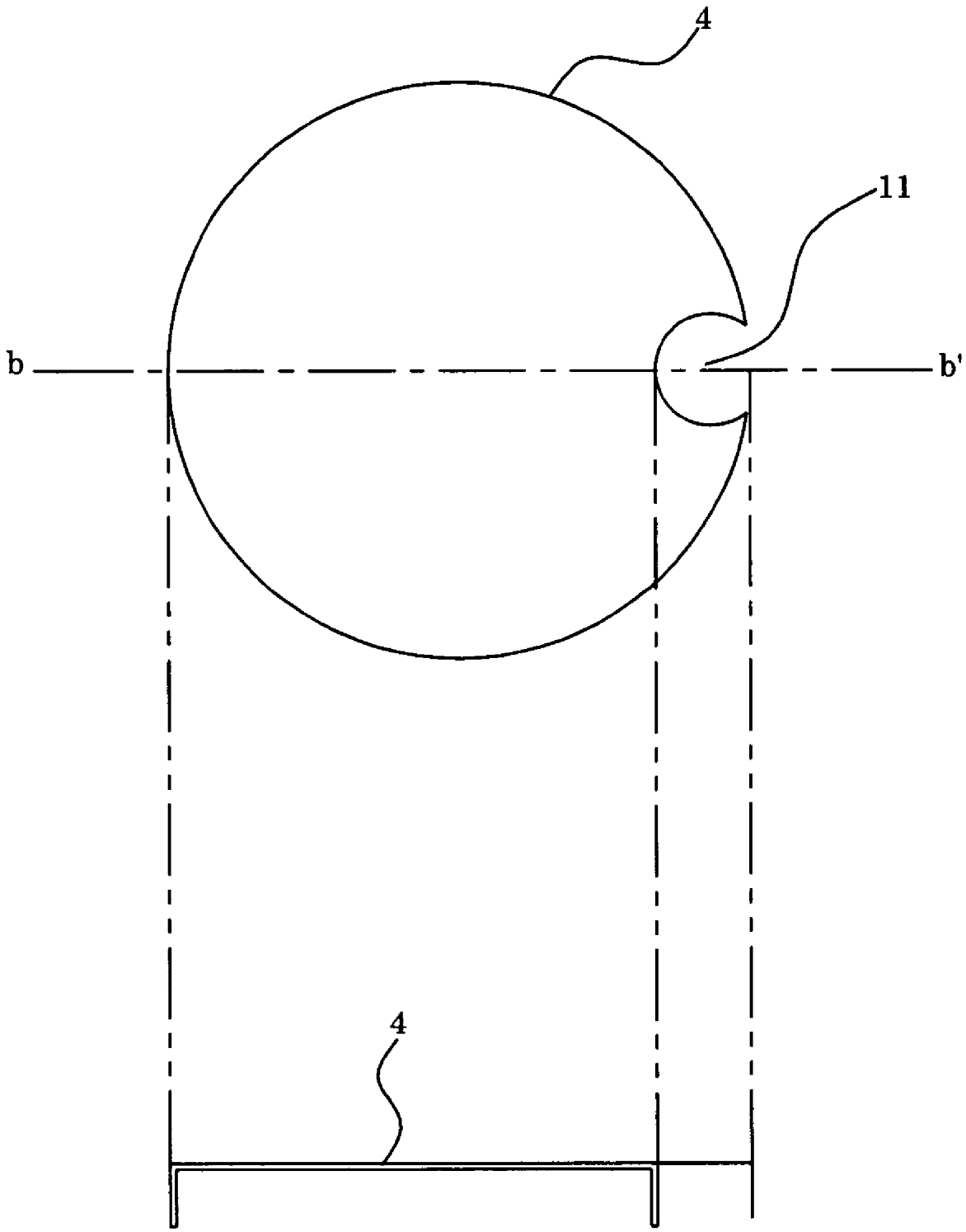
FIG. 4 is an aerial view of thermal insulating member and the cross sectional view of the member along the line b–b'.

FIG. 4 is an over view of thermal insulating member (4) and the cross-sectional view of the member along the line b–b'. The thermal insulating member (4) has an opening (11) at the edge for straw (9) insertion. The thermal insulating member (4) is installed at the bottom of the upper cup body (3) as shown in FIG. 2. The upper face of the thermal insulating member (4) is blocked and the lower face is open.

Figure 5:
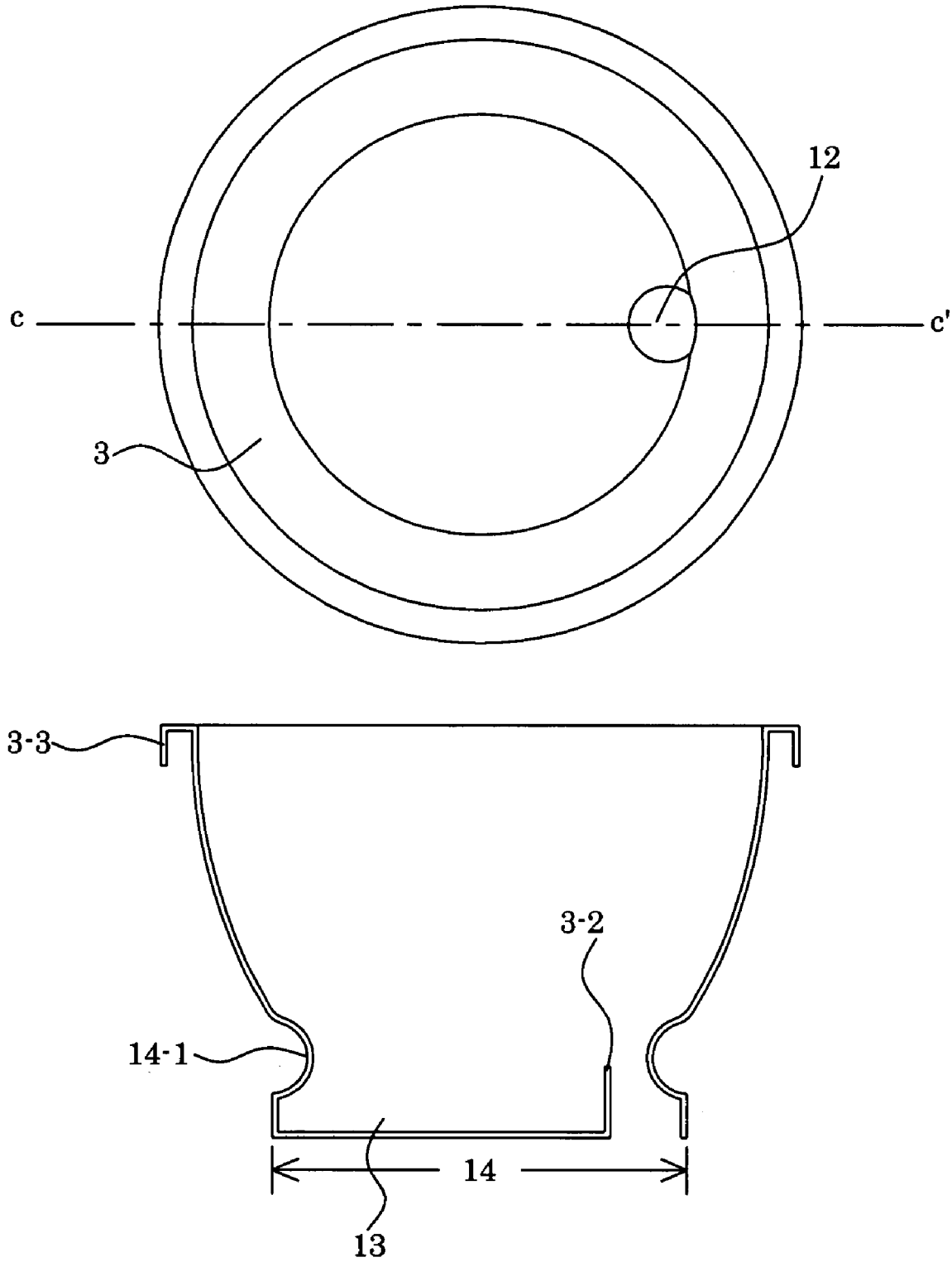
FIG. 5 is an aerial view of the upper cup body and the cross sectional view of the upper cup along the line c–c'.

FIG. 5 is an aerial view of the upper cup body (3) and the cross-sectional view of the upper cup along the line c–c'. The upper cup body (3) has a bowl shape, a broader upper mouth opening and a narrower bottom. The upper mouth opening has additional rim (3-3) folded outward. This additional rim is to insert the upper cup body in to other lower cup body, which has much larger cup mouth opening than the lower cup body (5) shown in FIG. 1 and FIG. 2. A hole (12) for a straw (9) is at the edge of the bottom (13) of the upper cup body (3). The hole (12) is guided by a wall (3-2) to prevent liquid from coming up to the upper cup body (3). The outer diameter of the lower bottom (14) is the same as inner diameter of the upper opening of the lower cup body (5). A groove (14-1) for an "O" ring (3-1) may lie along the outside of the lower bottom (14).

After a user fills the lower cup body (5), a user may engage the "O" ring. (3-1) into the groove (14-1) at the lower bottom (14) of the upper cup body (3). (The "O" ring may be engaged before displayed on shelf. A rubbery coating on the outside of the lower bottom (14) can be applied instead of the "O" ring.)

Insert the upper cup body (3) onto the opening mouth of the lower cup body (5) and insert the thermal insulating member (4) on the lower bottom of the upper cup body (3) while aligning the holes (11) and (12). Fill the upper cup body (3) with desired snacks and insert a straw through hole (11) and (12). The air captured under the thermal insulating member (4) works as a thermal insulating layer. If the drink in the lower cup body (5) is a cold soft drink and the snacks in the upper cup body (3) are hot, the thermal insulating layer created by the air captured in the thermal insulating member blocks the two different temperature regions. The cold soda remains cool longer than the conventional combination cup and keeps the snacks warm longer by insulating the cool region below.

After filling up both of the cups, insert the straw (9) through the hole (10) located on the edge of the lid cover (2) and put the lid cover (2) on the upper cup body (3).

The best use of this invention is to use a conventional cup as the lower cup body (5), and transparent or opaque plastic for the upper cup body (3), the thermal insulating member (4), and the lid cover (2). A conventional silicon rubber band 1 mm thick is sufficient for the "O" ring. A silicon rubber coating on the outer layer of the bottom is another option.

What is claimed is:

1. A novel combined cup which is comprised of; 1) a bowl-shaped upper cup body with a tube-type opening for a straw at the edge of the bottom, which has an outer diameter of the same size as the inner diameter of the upper opening of the lower cup body, with an additional rim folded outward and with a groove for an "O" ring along the outside of the bottom; 2) a lower cup body; 3) an insulating plate with an opening at the edge for straw insertion; 4) an "O" ring engaged on the groove developed along the outside of the bottom; and, 5) a lid cover for the upper cup body with a circular projection which has the same inner diameter as the outer diameter of the bottom of lower cup body.

* * * * *